US005558380A

United States Patent [19]

Meyer et al.

[11] Patent Number: 5,558,380

[45] Date of Patent: Sep. 24, 1996

[54] LOGGING GRAPPLE

[75] Inventors: Douglas G. Meyer; Stanley L. Irwin, both of Dubuque, Iowa

[73] Assignee: Deere & Company, Moline, Ill.

[21] Appl. No.: 308,778

[22] Filed: Sep. 19, 1994

[51] Int. Cl.[6] ..... B66C 1/42

[52] U.S. Cl. ..... 294/88; 294/106; 414/730

[58] Field of Search ..... 294/88, 106, 110.1, 294/118; 901/37; 414/730

[56] References Cited

U.S. PATENT DOCUMENTS

| | | | |
|---|---|---|---|
| 2,959,444 | 11/1960 | Callender | 294/88 |
| 3,371,952 | 3/1968 | Hunger | 294/88 |
| 3,439,818 | 4/1969 | O'Neil | 294/88 X |
| 3,817,567 | 6/1974 | Lull | 294/88 |
| 3,854,766 | 12/1974 | Jordan | 294/88 |
| 3,990,594 | 11/1976 | Olson et al. | 294/88 X |
| 4,023,848 | 5/1977 | Bennett . | |
| 4,379,674 | 4/1983 | Meisel, Jr. et al. | 294/88 X |
| 4,396,215 | 8/1983 | McCutcheon . | |
| 4,431,365 | 2/1984 | Sturtz, Jr. . | |
| 4,452,479 | 6/1984 | Terai et al. . | |
| 4,542,929 | 9/1985 | Possinger . | |
| 4,576,406 | 3/1986 | Johnson et al. . | |
| 4,682,931 | 7/1987 | House | 294/88 X |

OTHER PUBLICATIONS

Drawings from SUN entitled "High Capacity Flow Divider/Combiners", p. 7.15, No Date.

Drawings labelled "FS*A&FS*H Model Valves", No Date.

*Primary Examiner*—Dean Kramer

[57] ABSTRACT

A grapple comprising a grapple head to which is pivotally mounted left and right tongs. Two double acting hydraulic cylinders extend between the tong pivot points and the other tong. The piston side of the hydraulic cylinders are hydraulically coupled together by a closed center flow divider valve. A cross over relief valve assembly is mounted in parallel with the flow divider valve.

7 Claims, 1 Drawing Sheet

LOGGING GRAPPLE

BACKGROUND OF THE INVENTION

1. Field of the Invention

The inventon is directed to a grapple having two double acting hydraulic cylinders, one for each tong. A closed center flow divider and a cross over relief valve assembly are hydraulically positioned between the double acting hydraulic cylinders.

2. Description of the Prior Art

Skidders are large machines used for moving logs in a forest setting. Some skidders are provided with grapples which are used to grasp and hold the logs during transport. The grapples are provided with a grapple head which is mounted to the skidder. The grapple head is provided with two downwardly depending tongs for grabbing the logs. Some grapples use a single double acting hydraulic cylinder to grab and hold the logs, see U.S. Pat. Nos. 4,396,216, 4,431,365, and 4,576,406. The geometry of a single cylinder grapple is arranged so that the tongs moved together.

Grapples having two double acting hydraulic cylinders have also been used. A first hydraulic cylinder is used to drive the right tong and a second hydraulic cylinder is used to drive the left tong, see U.S. Pat. Nos. 4,023,848, 4,452,479, and 4,542,929. Typically these units are provided with a standard spool type flow divider or no flow divider. If no flow divider is used the tongs are subject to gross mistiming when higher resistance is encountered by one of the tongs. This is desirable when a non-uniform load is grappled because an equal grappling force is applied by both cylinders. A flow divider helps to maintain timing, but retiming is slow as it can only be made at the stalled leakage flow rate of the divider. In addition when the control valve is in neutral, the flow divider is in an open center position and application of an external load can cause flow between the cylinders resulting in the collapse of one tong and the opening of the other tong.

SUMMARY

It is an object of the present invention to provide a logging grapple using two double acting hydraulic cylinders that can be quickly rephased.

It is a feature of this invention that the piston side of the double acting hydraulic cylinders is provided with a cross over relief valve assembly.

It is another object of the present invention that when the control valve controlling the hydraulic circuit is in its neutral position, cross flow between the hydraulic cylinders will not occur unless the load exceeds the pressure relief settings of the cross over relief valve assembly.

The grapple of the present invention comprises a grapple head having a grapple mounting assembly for securing the grapple to the skidder. Left and right tongs are pivotally mounted to the grapple head and tong mounting assemblies. A first double acting hydraulic cylinder extends between the pivot point of the right tong and the left tong. A second double acting hydraulic cylinder extends between the pivot point of the left tong pivot point and the right tong.

Pressurized hydraulic fluid from a variable displacement pump is directed to a closed center control valve for selectively directing hydraulic fluid to the first and second hydraulic cylinders. Fluid directed to the piston sides of the hydraulic cylinders first passes through a closed center flow divider valve. A cross over relief valve assembly is mounted in parallel with the flow divider valve.

DETAILED DESCRIPTION

Figure 1:
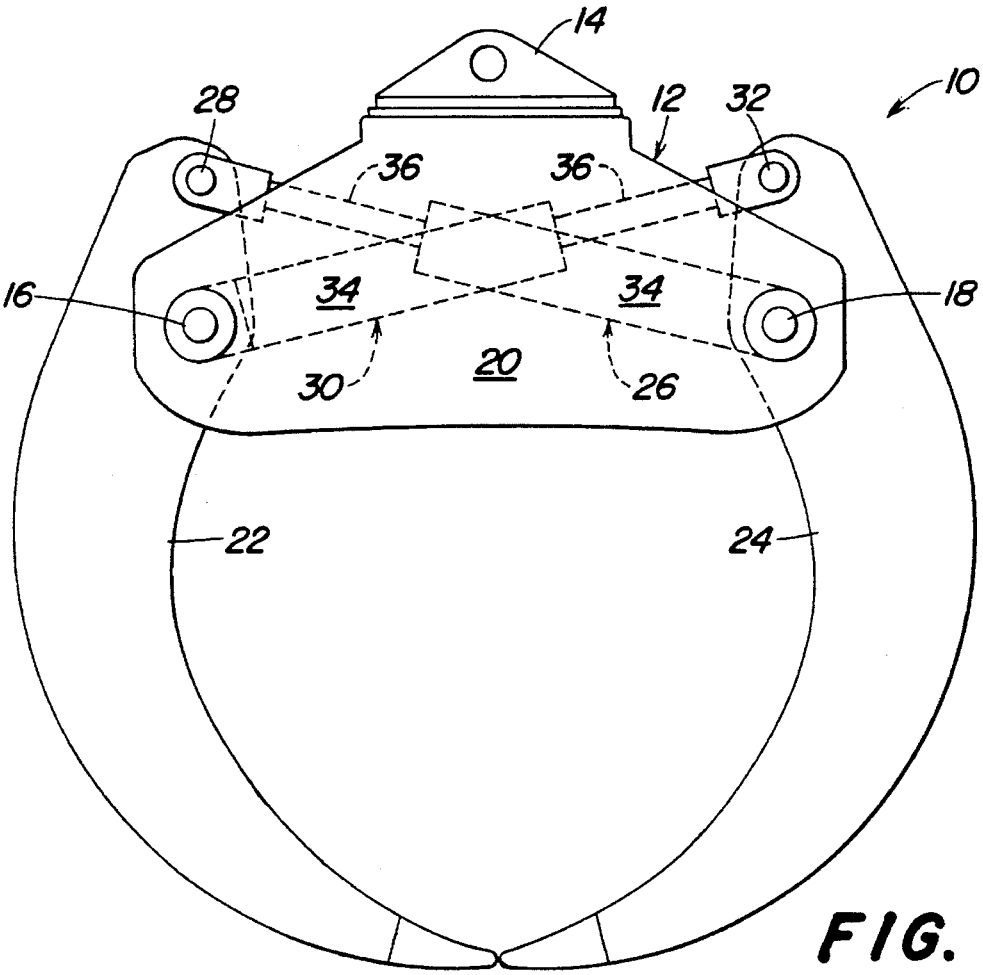
FIG. 1 is a rear view of the logging grapple.

The grapple 10, illustrated in FIG. 1, is provided with a grapple head 12 having a grapple mounting assembly 14 for securing the grapple to a logging skidder, and left and right tong mounting assemblies 16 and 18, respectively, for pivotally mounting tongs to the grapple head. The grapple head itself is a rigid head being provided with fore and aft triangular plates, aft plate 20 being illustrated. These plates are spaced from one another by webbing on the top and bottom. The top webbing is provided with the grapple mounting assembly 14. The left and right tong mounting assemblies 16 and 18 comprise pins extending between the plates to which the tongs are pivotally attached. As the grapple head is a rigid head the left and right tong mounting assemblies are fixed relative to one another.

The left tong 22 is pivotally mounted to the left tong mounting assembly 16, and the right tong 24 is pivotally mounting to the right tong mounting assembly 18. Both tongs are provided with apertures through which the pins extending across the fore and aft plates are inserted. It should be noted that the tongs are offset with respect to one another so they can be fully closed.

A first double acting hydraulic cylinder 26 is mounted between the first hydraulic cylinder mounting assembly 28 and the right tong mounting assembly 18. A second double acting hydraulic cylinder 30 is mounted between the second hydraulic cylinder mounting assembly 32 and the left tong mounting assembly 16. Each cylinder is provided with a piston side 34 and a rod side 36. The piston sides 34 are mounted to the tong mounting assemblies 16 and 18, whereas the rod sides are mounted to the hydraulic cylinder mounting assemblies 28 and 32.

Figure 2:
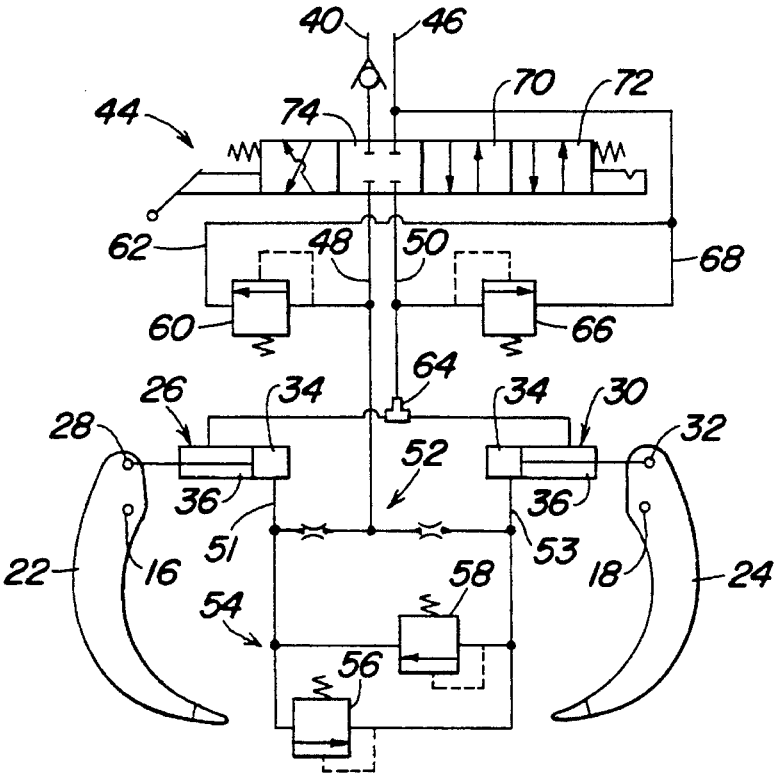
FIG. 2 is a hydraulic schematic for operating the grapple.

The hydraulic system for operating the grapple is illustrated in FIG. 2. Pressurized hydraulic fluid from a variable displacement pump is directed through supply line 40 to directional control valve 44. Exhausted fluid is directed to tank through return line 46. The control valve 44 selectively directs pressurized and exhausted hydraulic fluid to and from supply/return lines 48 and 50.

Supply/return line 48 is coupled to a closed center flow divider valve 52 which equalizes the flow of pressurized hydraulic fluid to the piston sides 34 of the double acting hydraulic cylinders 26 and 30. Hydraulic fluid is directed by the divider valve 52 to piston side lines 51 and 53. The flow divider valve 52 blocks off the flow between the lines 51 and 53 unless there is a pressure differential between line 48 and either line 51 or line 53. In this way, the flow divider valve 52 prevents cross flow of fluid between the hydraulic cylinders when the control valve is placed in its neutral position 74. The closed center flow divider valve used in the present hydraulic circuit is marketed by Sun Hydraulics of Sarasota, Fla. and is designated FSEH-XAN.

A cross over relief valve assembly 54 comprising two pressure relief valves 56 and 58 is connected in parallel with the flow divider valve 52. Both cross over pressure relief valves 56 and 58, in the present example, open when the pressure differential between their respective lines exceeds 1000 psi.

Supply/return line 48 is also provided with a pressure relief valve 60 which is coupled to return line 46 by branch return line 62. Pressure relief valve 60 is hydraulically coupled to the piston side of the hydraulic cylinders 26 and 30. In the present example, pressure relief valve 60 opens when pressures in line 48 exceeds 4000 psi.

Supply/return line 50 is coupled to T-coupling 64 where it is divided between the rod sides 36 of the double acting hydraulic cylinders 26 and 30. Supply/return line 50 is also provided with pressure relief valve 66 which is coupled to return line 46 by branch return line 68. As such, pressure relief valve 66 is hydraulically coupled to the rod side of the hydraulic cylinders 26 and 30. In the present example, pressure relief valve 66 opens when the pressure in line 50 exceeds 3500 psi.

To close the grapple tongs 22 and 24, from their open configuration to its closed configuration, to engage some logs, the operator shifts control valve 44 to position 70 where pressurized hydraulic fluid is directed from supply line 40 to supply/return line 48 and flow divider 52. The flow divider 52 directs the pressurized hydraulic fluid through lines 51 and 53 to the piston sides 34 of the hydraulic cylinders 26 and 30. As the hydraulic cylinders 26 and 30 are extended, each tong 22 and 24 pivots about its respective tong mounting assembly so that the tongs close on each other. Fluid exhausted from the rod sides 36 of the hydraulic cylinders 26 and 30 is directed through supply/return line 50 to the control valve 44 and to the tank by return line 46.

As the tongs close on each other they may encounter a non-uniform load. For example, if tong 24 encountered an object or was digging into the ground, both tongs 22 and 24 would continue to move in a uniform manner or become stalled. If the tongs stall, they would remain stalled until the pressure in line 53 exceeds the pressure in line 51 by 1000 psi. At that pressure differential, pressure relief valve 58 opens, directing fluid to the piston side of hydraulic cylinder 26. Tong 22 would be driven by hydraulic cylinder 26 towards the stalled tong 24 until the pressure differential between the lines 51 and 53 was less than 1000 psi. When the pressure differential drops below 1000 psi both tongs again would move in a uniform manner.

As the logs are pulled up by the tongs, tong 22 would be in the lead as it was not stalled as long as tong 24. As the logs are compressed against the grapple head 20 pressure would build up in line 51 until it exceeds the pressure in line 53 by 1000 psi. At that point pressure relief valve 56 would open and tong 24 would be driven towards the stalled tong 22 by hydraulic cylinder 30. When the pressure differential between lines 51 and 53 drops below 1000 psi the operator would shift the control valve 44 to its detented holding position 72 to hold the logs as he directs the skidder to its unloading location.

The cross port relief valves 56 and 58 in conjunction with pressure relief valve 60 limit peak pressures between the flow divider 52 and the hydraulic cylinders 26 and 30. More specifically peak pressures are limited to the relief setting of pressure relief valve 60 plus the pressure relief setting of the cross over relief valves 56 and 58. For example the peak pressure on the piston side of the hydraulic cylinder in the present example is limited to 5000 psi. This is calculated by adding the pressure setting (1000 psi) of one of the cross over relief valves to the pressure setting (4000 psi) of pressure relief valve 60. The peak pressure on the rod side is limited to 3500 psi the pressure setting of relief valve 66.

The invention should not be limited by the above described embodiment, but should be limited solely by the claims that follow.

We claim:

1. A logging grapple for use with a logging skidder, the grapple comprising:

a rigid grapple head having a grapple mounting assembly for mounting the grapple head to a logging skidder and left and right tong mounting assemblies for pivotally mounting tongs to the grapple head, the left and right tong mounting assemblies are fixed relative to one another;

a left tong is pivotally mounted to the left tong mounting assembly, the left tong having a first hydraulic cylinder mounting assembly;

a right tong is pivotally mounted to the right tong mounting assembly, the right tong having a second hydraulic cylinder mounting assembly;

a first double acting hydraulic cylinder is mounted between the first hydraulic cylinder mounting assembly and the right tong mounting assembly;

a second double acting hydraulic cylinder is mounted between the second hydraulic cylinder mounting assembly and the left tong mounting assembly.

2. A grapple as defined by claim 1 wherein a closed center flow divider is hydraulically positioned between the first double acting hydraulic cylinder and the second double acting hydraulic cylinder.

3. A grapple as defined by claim 2, wherein the first and second double acting hydraulic cylinders have a rod side and a piston side, the piston side of the first and second double acting hydraulic cylinders are in hydraulic communication with the closed center flow divider.

4. A grapple as defined by claim 3 wherein the piston sides of the first and second hydraulic cylinders are pivotally mounted to the grapple head and the rod side of the first and second double acting hydraulic cylinders is mounted to the tongs.

5. A grapple as defined by claim 4 wherein applying pressurized hydraulic fluid to the closed center flow divider directs pressurized hydraulic fluid to the piston sides of the first and second double acting hydraulic cylinders pivoting the right and left tongs together.

6. A grapple as defined by claim 5 wherein a cross over relief valve assembly is hydraulically positioned between the first and second double acting hydraulic cylinders.

7. A grapple as defined by claim 6 wherein the cross over relief valve assembly is in hydraulic communication with the piston sides of the first and second double acting hydraulic cylinders.

* * * * *